US005087007A

United States Patent [19]

Gaderick

[11] Patent Number: 5,087,007

[45] Date of Patent: Feb. 11, 1992

[54] COMBINATION SHOWER ENCLOSURE CADDY AND GARMENT HANGER

[76] Inventor: Franklin Gaderick, 106 Greenwich Hills Dr., Greenwich, Conn. 06831

[21] Appl. No.: 701,685

[22] Filed: May 13, 1991

Related U.S. Application Data

[63] Continuation-in-part of Ser. No. 553,221, Jul. 16, 1990, abandoned.

[51] Int. Cl.[5] ..... A47B 96/06

[52] U.S. Cl. ..... 248/215; 248/108; 248/301

[58] Field of Search ..... 248/215, 301, 304, 307, 248/339, 340, 214, 108, 682; 211/113; D8/371, 372

[56] References Cited

U.S. PATENT DOCUMENTS

| | | | |
|---|---|---|---|
| 198,173 | 7/1923 | Blears | 248/108 |
| D. 293,183 | 12/1987 | Aaron | D6/525 |
| D. 309,225 | 7/1990 | Scarbro | D6/525 |
| 2,472,058 | 6/1949 | Artley | 248/316.7 X |
| 2,606,734 | 8/1952 | Magnuson | 248/301 |
| 2,705,385 | 4/1955 | Markward | 248/215 |
| 3,223,373 | 12/1965 | Molinaro | 248/339 |
| 3,536,287 | 10/1970 | Kramer | 248/301 |
| 4,123,024 | 10/1978 | Levy | 248/214 |
| 4,398,309 | 8/1983 | Simons | D6/525 X |
| 4,548,572 | 10/1985 | Hoffman | D6/525 X |
| 4,856,744 | 8/1989 | Frankel | 248/304 X |
| 4,979,712 | 12/1990 | Rios | 248/215 |

FOREIGN PATENT DOCUMENTS

| | | | |
|---|---|---|---|
| 1236 | of 1892 | United Kingdom | 248/215 |
| 9593 | of 1905 | United Kingdom | 248/215 |

*Primary Examiner*—Carl D. Friedman
*Assistant Examiner*—Korie H. Chan
*Attorney, Agent, or Firm*—Alfred E. Miller

[57] ABSTRACT

A shower door caddy and garment hanger in combination in a U-shaped integral device having a pair of legs which can be fitted over top molding of a sliding shower door or the cylindrical rod for a shower curtain having shelf members slantedly positioned on one leg on the inside of the shower for receiving personal care tube products, and spaced hooks on the outside of the other leg on the shower for accommodating towels and articles of clothing.

2 Claims, 3 Drawing Sheets

COMBINATION SHOWER ENCLOSURE CADDY AND GARMENT HANGER

This application is a continuation-in-part of application Ser. No. 553,221, filed Jul. 16, 1990, now abandoned.

BACKGROUND OF THE INVENTION AND DESCRIPTION OF THE PRIOR ART

The present invention relates to a combination shower door caddy and garment hanger device in which the caddy is specifically designed for holding tubes of viscous substances, such as hair shampoos and conditioners, horizontally in spaced cradles on one leg on an inverted U-shaped device, while the other leg is provided with spaced hooks. Consequently, the device is placed over a shower door or the like with the caddy arrangement having shower products being located on the inside of the shower door while the hangers are located on the outside of the shower door, thus providing hooks for towels, bathrobes, or other garments in the dry area outside of the door. The device is especially suitable in a stand-up shower whereby the tubes of products for personal care are easily accessible from the inside of the shower while towels and articles of clothing are suspended on the outside of the shower to be readily accessible when the person taking the shower slides the door, or moves a hinged door, to an open position and steps out of the shower. There are a number of patents directed to devices or supports which are suspended from a shower door or a bath stall. Typical devices are shown in U.S. Pat. No. 4,398,309 to Simons, U.S. Pat. No. 4,033,538 to Levy, U.S. Pat. No. 4,405,109 to Murdock and U.S. Design Pat. No. 251,999 to Batista. The devices are either intended to hold or support soap bars or shower accessories, as in the patents to Simons and Batista, or articles of clothing or hygienic equipment, as shown in the patents to Levy and Murdock. However, none of these patents show a combination shower caddy and garment hanger in which the items for use in a bath stall are held within the shower enclosure while the items for use outside the bathing area are supported on spaced hooks. Thus, applicant's integral unit can be installed frictionally over a molding of a sliding shower door, or on a side support panel of a hinged door, as well as on a horizontal, elongated pole for a shower curtain. Consequently, all the bath and clothing needs of the person taking a shower or bath are close at hand.

SUMMARY OF THE INVENTION

It is the object of the present invention to provide a combination shower caddy and garment hanger which is of an integral, one-piece construction having an inverted U-shape configuration which fits snugly over a shower door, and is held in place by friction.

It is a further object of the present invention to provide a combination shower door caddy and garment hanger in which the horizontally disposed, semi-circular support members for retaining tubes of viscous personal care products are mounted thereon and spaced vertically.

It is another object of the present invention to provide the alternate embodiment of the present invention having semi-circular support members with openings therein for providing effective drainage of water falling on the support members.

Another object of the present invention is to provide a combination shower caddy and garment hanger which fits over and is frictionally held on the top molding of a sliding shower door or the adjacent side panel of a pivotable door, and does not interfere with the passage of the bather into and out of the shower area A further object of the present inventions is to provide an article for use in a shower stall that is constructed and useful so as to be reliably effective for the purposes intended.

In order that the invention may be more clearly understood, it will now be disclosed in greater detail with reference to the accompanying drawings, wherein:

DESCRIPTION OF THE PREFERRED EMBODIMENTS

Figure 1:
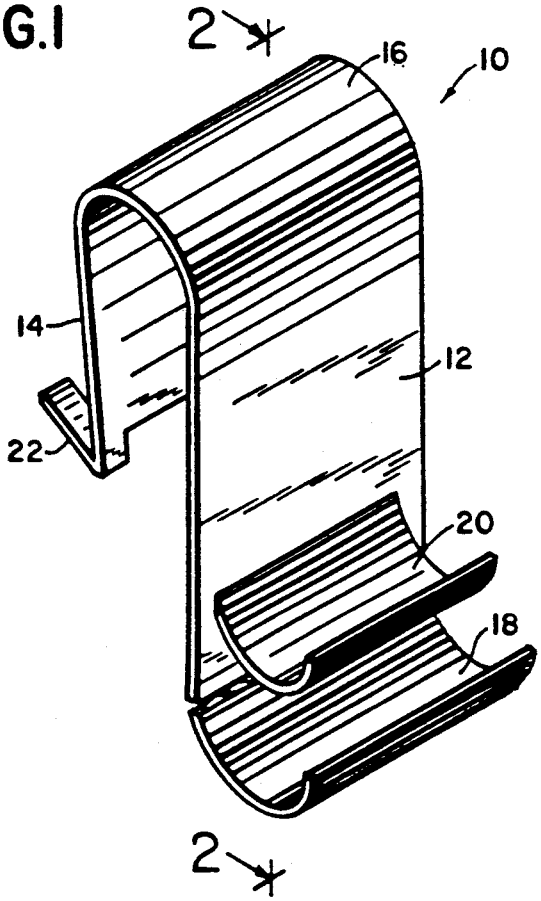
FIG. 1 is a perspective view of the combination shower enclosure caddy and garment hanger constructed in accordance with the teachings of my invention.
Figure 2:
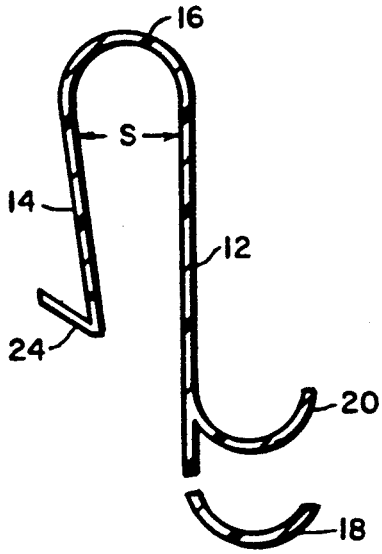
FIG. 2 is a side elevational view thereof.
Figure 3:
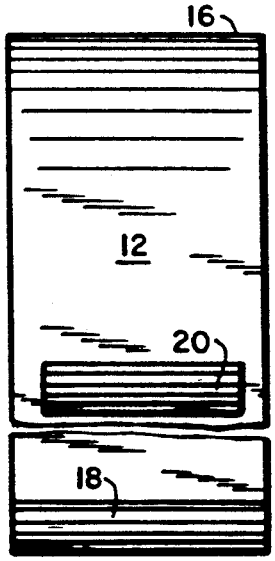
FIG. 3 is a front elevational view thereof.
Figure 4:
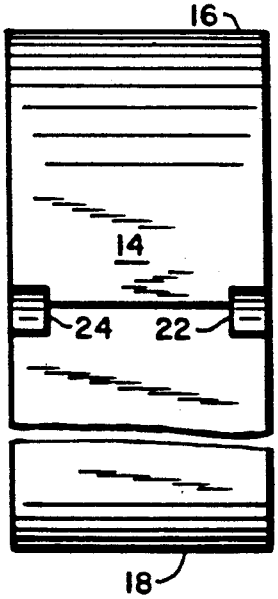
FIG. 4 is a rear elevational view thereof.
Figure 5:
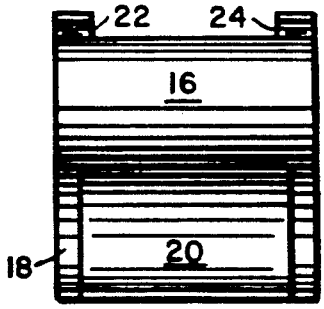
FIG. 5 is a top view thereof.
Figure 6:
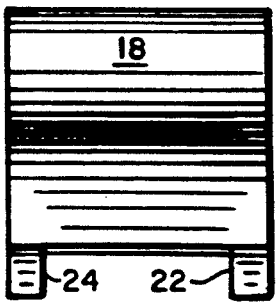
FIG. 6 is a bottom view thereof.

Referring now to FIGS. 1–7, it should be noted that the present device is preferable fabricated of a integral sheet of a fairly rigid plastic material, such as polypropylene, and the unit, as shown in the drawings, is referred to generally by the reference numeral 10, and has a inverted U-shaped configuration. The legs 12 and 14 are spaced from each other and connected by a bight portion 16. The spacing between the legs 12 and 14 is such that the device fits snugly over the top molding of a sliding shower door assembly, a shower door support or over a shower curtain support pole.

Figure 7:
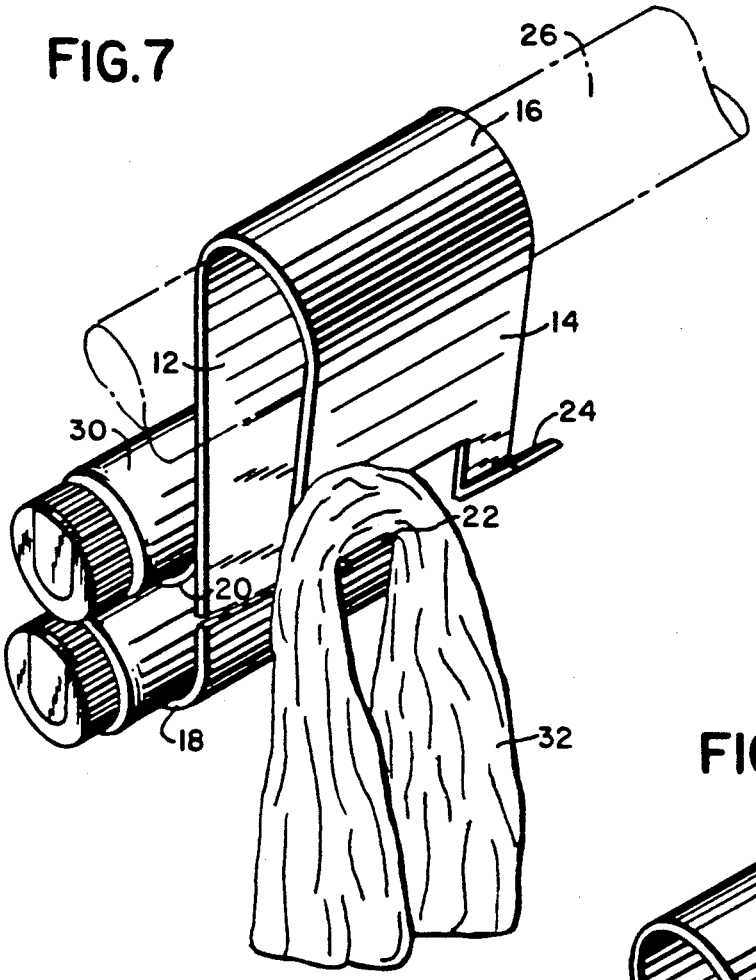
FIG. 7 is a perspective view similar to that shown in FIG. 1 however illustrating tubes being held in spaced relationship in the bathing area in the shower enclosure while a towel is shown on one of the spaced hooks on the outside of the shower enclosure.

The leg 12 is provided with two spaced, semi-circular support members 18 and 20. The support members are oriented horizontally so that the tubes of viscous substances held therein are easily accessible although securely held by the support members 18 and 20. The majority of the presently manufactured tubes of shampoos having a cylindrical body are provided with a cap comprising an outer fixed sleeve and pivoting closure disc in said sleeve having an opening in the edge which in one position is closed by the fixed sleeve, and in another position is open for free flow of the contents out of the tube. A tube of this type as seen in FIG. 7 is suited for being held in each of the semi-circular or curved support members 18 and 20. Consequently, the user of the tube in the bathing area can easily access the tube contents while taking a shower.

The other leg 14 of the device is provided with spaced upturned hooks 22 and 24 for use as explained hereinafter.

As seen in FIG. 7 the combination shower enclosure caddy and garment hanger device can be inserted over a shower curtain rod 26 or the top molding of a sliding glass shower door enclosure or adjacent support panel (not shown). The integral device is provided with a spacing S which frictionally engages the pole or the top molding of the shower door enclosure to securely hold the device in the selected location. Since the leg 12 is positioned within the shower area the horizontally oriented and spaced support members 18 and 20 can accommodate tubes 28 and 30 of personal care viscous substances so that these tubes are easily removed and returned to their support members while taking a shower. Also, as seen in FIG. 7, a towel 32 is held on one of the hooks 22 and 24 while various articles of clothing (not shown) can be supported on the other hook. It should be evident that this arrangement permits a bather who is taking a shower to have his or her shower items on the inside of the shower door or shower curtain, and to obtain a dry towel and clothes on the outside of the shower enclosure to facilitate one's showering and dressing.

Figure 8:
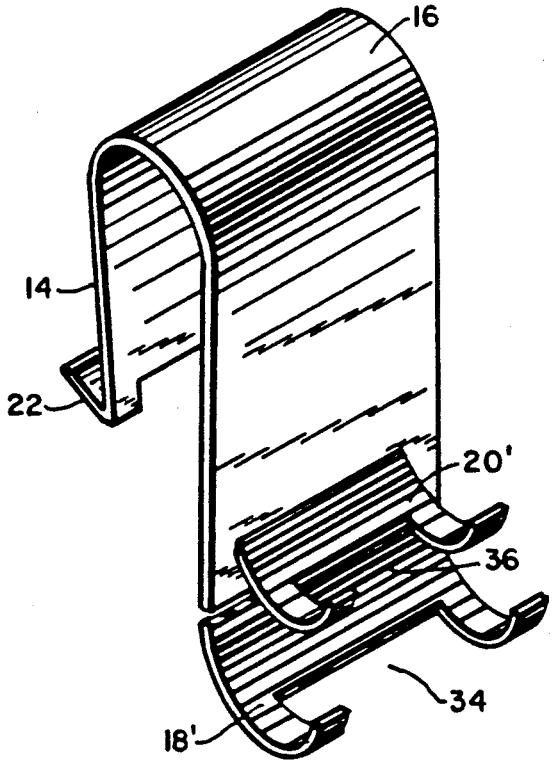
FIG. 8 is a perspective view of an alternate embodiment of the present invention in which the semi-circular tube support members are provided with openings for drainage purposes.

Referring to FIG. 8 which shows a combination shower enclosure caddy and garment hanger device similar to that shown in FIG. 7, however, the support members 1 and 2 are each provided with elongated openings 34 and 36 in order to provide drainage for shower water that may be accumulated in either of the semi-circular support members without interfering with the placement of the tubes 28 and 30.

Figure 9:
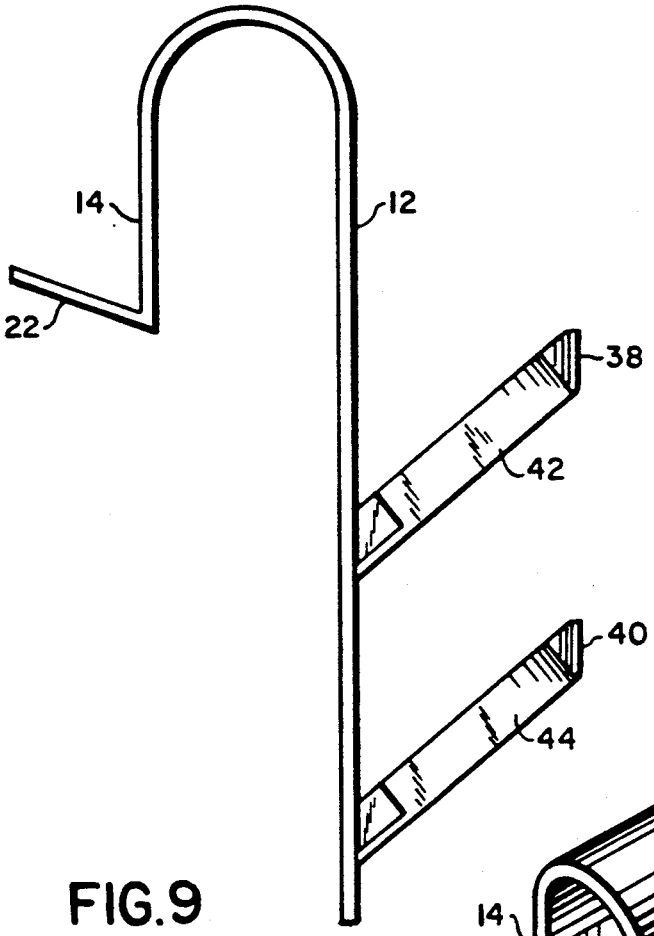
FIG. 9 is a side elevational view of an alternate embodiment of the present invention.
Figure 10:
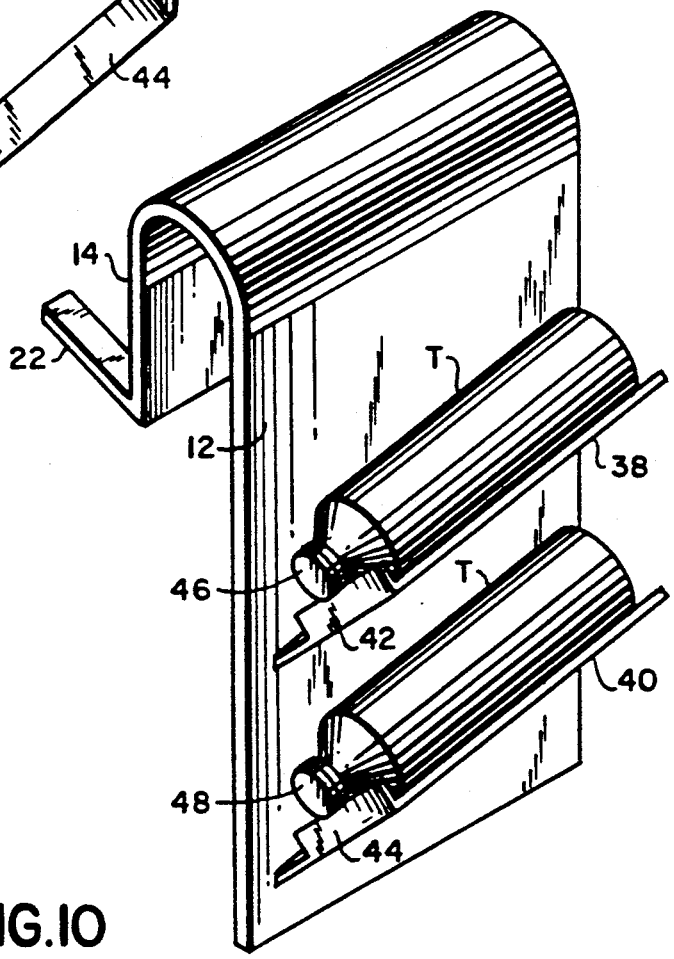
FIG. 10 is a perspective view showing the angled support members accommodating cylindrical tubes of viscous substances.

FIGS. 9 and 10 show an alternate embodiment of the present invention of a combination shower enclosure caddy in the inside of the shower area, and a garment hanger on the outside of the shower area wherein like parts as shown and described hereinbefore, bear the same reference numerals. The inverted U-shaped member 10 is provided with spaced legs 12 and 14, as well as at least one upturned clothing hook 22. The leg 12 which is positioned in the interior of the shower area has spaced support members 38 and 40 which are angularly fixed on leg 12 relative to the horizontal orientation of the spaced supports shown in FIGS. 1 and 2. At the forward and downward side of the support members 38 and 40 are upstanding flanges, or lips, 42 and 44 respectively. Consequently, as shown in FIG. 10, the flanges 42 and 44 prevent the tubes T of viscous fluid from sliding off the respective support members, and at the same time ensures that the viscous fluid or substance in each of the tubes remains in the bottom side of the tubes adjacent to the necks and caps 46 and 48 of the tubes. Thus, the viscous contents of the tubes remains in the bottom of the tubes by gravitational effect. Therefore, the user does not have to invert the tube and wait for the viscous substances to flow out of the discharge opening of the tube but that a rapid and easy pouring out or discharge of the viscous contents of a tube can be accomplished. Furthermore, the present construction is economical since virtually all of the contents of the tube can be utilized.

Although the present invention has been disclosed and described with reference to two embodiments thereof, it should be made apparent that other variations and modifications may be made, and it is intended in the following claim to cover each said variation and modification as follows within the true spirit and scope of the invention.

I claim:

1. A one piece device for use in a shower area and positioned over a shower door, adjacent fixed panel for said shower door, or a support rod for a shower curtain comprising: an inverted U-shaped body adapted to fit over the shower door or the support rod like and provided with one depending leg on the inside of the shower area and another depending spaced leg located on the outside of the shower area, at least one elongated shelf slantedly positioned on said leg on the inside of the shower area and having an upstanding flange at a lower end of said shelf slanted for holding a tube of personal care substance having a cap within the shower area and ensuring that the viscous substance in the tube remains in the bottom side of the tube adjacent to the cap, and one pair of horizontally spaced hooks on said other leg for suspending towels and clothing articles and the like in the area outside of said shower.

2. A device as claimed in claim 1 further claiming two elongated shelves slantedly positioned on said one depending leg inside said shower and spaced from each other, and each of said shelves having an upstanding flange on the respective lower ends of said shelves.

* * * * *